United States Patent [19]

Huang et al.

[11] Patent Number: 4,902,474

[45] Date of Patent: Feb. 20, 1990

[54] GALLIUM-MODIFIED TITANIUM ALUMINUM ALLOYS AND METHOD OF PREPARATION

[75] Inventors: Shyh-Chin Huang, Latham; Michael F. Gigliotti, Jr., Scotia, both of N.Y.

[73] Assignee: General Electric Company, Schenectady, N.Y.

[21] Appl. No.: 293,035

[22] Filed: Jan. 3, 1989

[51] Int. Cl.[4] ..... C22C 14/00

[52] U.S. Cl. ..... 420/418; 75/228; 420/420

[58] Field of Search ..... 420/418, 420; 75/228

[56] References Cited

U.S. PATENT DOCUMENTS 4,294,615 10/1981 Blackburn ..... 148/11.5 F
4,842,819 6/1989 Huang et al. ..... 148/421

OTHER PUBLICATIONS

Vujic et al., Met. Trans. 19A (Oct. 1988), 2445.

*Primary Examiner*—Upendra Roy
*Attorney, Agent, or Firm*—Paul E. Rochford; James C. Davis, Jr.; James Magee, Jr.

[57] ABSTRACT

A TiAl composition is prepared to have high strength and to have improved ductility by altering the atomic ratio of the titanium and aluminum to have what has been found to be a highly desirable effective aluminum concentration by addition of gallium according to the approximate formula $Ti_{52-47}Al_{42-46}Ga_{3-7}$.

12 Claims, 4 Drawing Sheets

GALLIUM-MODIFIED TITANIUM ALUMINUM ALLOYS AND METHOD OF PREPARATION

CROSS REFERENCE TO RELATED APPLICATIONS

The subject application relates to copending applications as follows:

Ser. Nos. 138,476, 4,857,268, 138,481, 4,842,819, 138,486, 4,842,820 and 138,408, aband. concurrently filed Dec. 28, 1987; Ser. No. 201,984, 4,879,092, filed 6-3-88; filed 10-3-88.

The texts of these related applications are incorporated herein by reference.

BACKGROUND OF THE INVENTION

The present invention relates generally to alloys of titanium and aluminum. More particularly it relates to alloys of titanium and aluminum which have been modified both with respect to stoichiometric ratio and with respect to gallium addition.

It is known that as aluminum is added to titanium metal in greater and greater proportions the crystal form of the resultant titanium aluminum composition changes. Small percentages of aluminum go into solid solution in titanium and the crystal form remains that of alpha titanium. At higher concentrations of aluminum (including about 25 to 35 atomic %) an intermetallic compound $Ti_3Al$ is formed. The $Ti_3Al$ has an ordered hexagonal crystal form called alpha-2. At still higher concentrations of aluminum (including the range of 50 to 60 atomic % aluminum) another intermetallic compound, TiAl, is formed having an ordered tetragonal crystal form called gamma.

The alloy of titanium and aluminum having a gamma crystal form, and a stoichiometric ratio of approximately one, is an intermetallic compound having a high modulus, a low density, a high thermal conductivity, good oxidation resistance, and good creep resistance. The relationship between the modulus and temperature for TiAl compounds to other alloys of titanium and in relation to nickel base superalloys is shown in FIG. 1. As is evident from the figure the TiAl has the best modulus of any of the titanium alloys. Not only is the TiAl modulus higher at higher temperature but the rate of decrease of the modulus with temperature increase is lower for TiAl than for the other titanium alloys. Moreover, the TiAl retains a useful modulus at temperatures above those at which the other titanium alloys become useless. Alloys which are based on the TiAl intermetallic compound are attractive lightweight materials for use where high modulus is required at high temperatures and where good environmental protection is also required.

One of the characteristics of TiAl which limits its actual application to such uses is a brittleness which is found to occur at room temperature. Also the strength of the intermetallic compound at room temperature needs improvement before the TiAl intermetallic compound can be exploited in structural component applications. Improvements of the TiAl intermetallic compound to enhance ductility and/or strength at room temperature are very highly desirable in order to permit use of the compositions at the higher temperatures for which they are suitable.

With potential benefits of use at light weight and at high temperatures, what is most desired in the TiAl compositions which are to be used is a combination of strength and ductility at room temperature. A minimum ductility of the order of one percent is acceptable for some applications of the metal composition but higher ductilities are much more desirable. A minimum strength for a composition to be useful is about 50 ksi or about 350 MPa. However, materials having this level of strength are of marginal utility and higher strengths are often preferred for some applications.

The stoichiometric ratio of TiAl compounds can vary over a range without altering the crystal structure. The aluminum content can vary from about 50 to about 60 atom percent. The properties of TiAl compositions are subject to very significant changes as a result of relatively small changes of one percent or more in the stoichiometric ratio of the titanium and aluminum ingredients. Also the properties are similarly affected by the addition of relatively similar small amounts of ternary elements.

PRIOR ART

There is extensive literature on the compositions of titanium aluminum including the $Ti_3Al$ intermetallic compound, the TiAl intermetallic compounds and the $Ti\ Al_3$ intermetallic compound. A patent, 4,294,615, entitled "Titanium Alloys of the TiAl Type" contains an extensive discussion of the titanium aluminide type alloys including the TiAl intermetallic compound. As is pointed out in the patent in column 1 starting at line 50 in discussing TiAl's advantages and disadvantages relative to $Ti_3Al$:

> "It should be evident that the TiAl gamma alloy system has the potential for being lighter inasmuch as it contains more aluminum. Laboratory work in the 1950's indicated that titanium aluminide alloys had the potential for high temperature use to about 1000° C. But subsequent engineering experience with such alloys was that, while they had the requisite high temperature strength, they had little or no ductility at room and moderate temperatures, i.e., from 20° to 550° C. Materials which are too brittle cannot be readily fabricated, nor can they withstand infrequent but inevitable minor service damage without cracking and subsequent failure. They are not useful engineering materials to replace other base alloys."

It is known that the alloy system TiAl is substantially different from $Ti_3Al$ (as well as from solid solution alloys of Ti) although both TiAl and $Ti_3Al$ are basically ordered titanium aluminum intermetallic compounds. As the '615 patent points out at the bottom of column 1:

> "Those well skilled recognize that there is a substantial difference between the two ordered phases. Alloying and transformational behavior of $Ti_3Al$ resemble those of titanium as the hexagonal crystal structures are very similar. However, the compound TiAl has a tetragonal arrangement of atoms and thus rather different alloying characteristics. Such a distinction is often not recognized in the earlier literature."

The '615 patent does describe the alloying of TiAl with vanadium and carbon to achieve some property improvements in the resulting alloy.

A number of technical publications dealing with the titanium aluminum compounds as well as with the characteristics of these compounds are as follows:

1. E.S. Bumps, H.D. Kessler, and M. Hansen, "Titanium-Aluminum System", *Journal of Metals,* June, 1952, pp. 609–614, TRANSACTIONS AIME, Vol. 194.
2. H.R. Ogden, D.J. Maykuth, W.L. Finlay, and R.I. Jaffee, "Mechanical Properties of High Purity Ti-Al Alloys", *Journal of Metals,* February, 1953, pp. 267–272, TRANSACTIONS AIME, Vol. 197.
3. Joseph B. McAndrew, and H.D. Kessler, "Ti-36 Pct Al as a Base for High Temperature Alloys", *Journal of Metals,* October, 1956, pp. 1348–1353, TRANSACTIONS AIME, Vol. 206.

BRIEF DESCRIPTION OF THE INVENTION

One object of the present invention is to provide a method of forming a titanium aluminum intermetallic compound having improved ductility and related properties at room temperature.

Another object is to improve the properties of titanium aluminum intermetallic compounds at low and intermediate temperatures.

Another object is to provide an alloy of titanium and aluminum having improved properties and processability at low and intermediate temperatures.

Other objects will be in part apparent and in part pointed out in the description which follows.

In one of its broader aspects the objects of the present invention are achieved by providing a nonstoichiometric TiAl base alloy, and adding a relatively low concentration of gallium to the nonstoichiometric composition. The addition may be followed by rapidly solidifying the gallium-containing nonstoichiometric TiAl intermetallic compound. Addition of gallium in the order of approximately 3 to 7 atomic percent is contemplated.

The rapidly solidified composition may be consolidated as by isostatic pressing and extrusion to form a solid composition of the present invention.

DETAILED DESCRIPTION OF THE INVENTION

Figure 1:
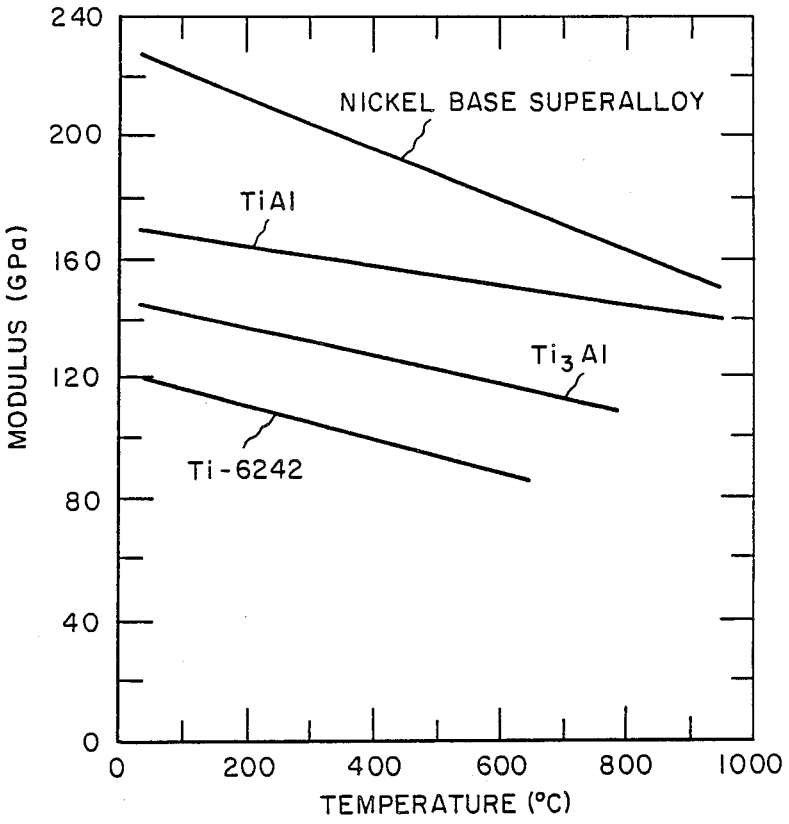
FIG. 1 is a graph illustrating the relationship between modulus and temperature for an assortment of alloys.

EXAMPLES 1–3:

Three individual melts were prepared to contain titanium and aluminum in various stoichiometric ratios approximating that of TiAl. The compositions, annealing temperatures and test results of tests made on the compositions are set forth in Table I.

For each example the alloy was first made into an ingot by electro arc melting. The ingot was processed into ribbon by melt spinning in a partial pressure of argon. In both stages of the melting, a water-cooled copper hearth was used as the container for the melt in order to avoid undesirable melt-container reactions. Also care was used to avoid exposure of the hot metal to oxygen because of the strong affinity of titanium for oxygen.

The rapidly solidified ribbon was packed into a steel can which was evacuated and then sealed. The can was then hot isostatically pressed (HIPped) at 950° C. (1740° F.) for 3 hours under a pressure of 30 ksi. The HIPping can was machined off the consolidated ribbon plug. The HIPped sample was a plug about one inch in diameter and three inches long.

The plug was placed axially into a center opening of a billet and sealed therein. The billet was heated to 975° C. (1787° F.) and is extruded through a die to give a reduction ratio of about 7 to 1. The extruded plug was removed from the billet and was heat treated.

The extruded samples were then annealed at temperatures as indicated in Table I for two hours. The annealing was followed by aging at 1000° C. for two hours. Specimens were machined to the dimension of $1.5\times3\times25.4$ mm ($0.060\times0.120\times1.0$ in) for four point bending tests at room temperature. The bending tests were carried out in a 4-point bending fixture having an inner span of 10 mm (0.4 in) and an outer span of 20 mm (0.8 in). The load-crosshead displacement curves were recorded. Based on the curves developed the following properties are defined:

1. Yield strength is the flow stress at a cross head displacement of one thousandth of an inch. This amount of cross head displacement is taken as the first evidence of plastic deformation and the transition from elastic deformation to plastic deformation. The measurement of yield and/or fracture strength by conventional compression or tension methods tends to give results which are lower than the results obtained by four point bending as carried out in making the measurements reported herein. The higher levels of the results from four point bending measurements should be kept in mind when comparing these values to values obtained by the conventional compression or tension methods. However, the comparison of measurements results in the examples herein is between four point bending tests for all samples measured and such comparisons are quite valid in establishing the differences in strength properties resulting from differences in composition or in processing of the compositions.
2. Fracture strength is the stress to fracture.
3. Outer fiber strain is the quantity of 9.71hd, where h is the specimen thickness in inches and d is the cross head displacement of fracture in inches. Metallurgically, the value calculated represents the amount of plastic deformation experienced at the outer surface of the bending specimen at the time of fracture.

Figure 2:
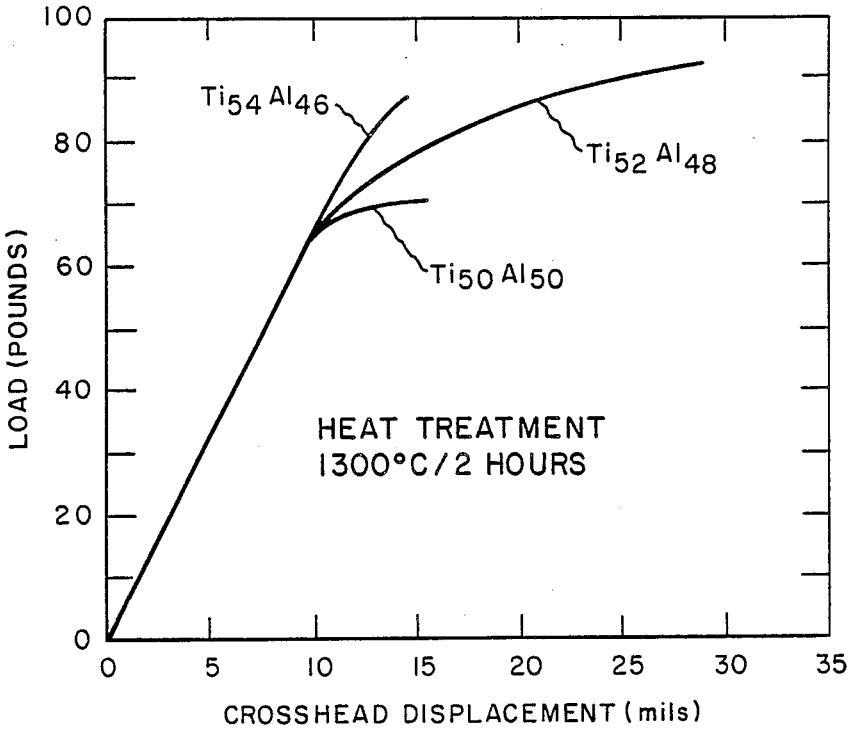
FIG. 2 is a graph illustrating the relationship between load in pounds and crosshead displacement in mils for TiAl compositions of different stoichiometry tested in 4-point bending.

The results are listed in the following Table I. Table I contains data on the properties of samples annealed at 1300° C. and further data on these samples in particular is given in FIG. 2.

TABLE I

| Ex. No. | Gamma Alloy No. | Compostn. (at. %) | Anneal Temp (°C.) | Yield Strength (ksi) | Fracture Strength (ksi) | Outer Fiber Strain (%) |
|---|---|---|---|---|---|---|
| 1 | 83 | $Ti_{54}Al_{46}$ | 1250 | 131 | 132 | 0.1 |
| | | | 1300 | 111 | 120 | 0.1 |
| | | | 1350 | —* | 58 | 0 |
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| | | | 1400 | 70 | 85 | 0.2 |
| 3 | 85 | $Ti_{50}Al_{50}$ | 1250 | 83 | 92 | 0.3 |
| | | | 1300 | 93 | 97 | 0.3 |
| | | | 1350 | 78 | 88 | 0.4 |

*No measurable value was found because the sample lacked sufficient ductility to obtain a measurement It is evident from the data of this table that alloy 12 for Example 2 exhibited the best combination of properties. This conforms that the properties of Ti-Al compositions are very sensitive to the Ti/Al atomic ratios and to the heat treatment applied. Alloy 12 was selected as the base alloy for further property improvements based on further experiments which was performed as described below.

It is also evident that the anneal at temperatures between 1250° C. and 1350° C. results in the test specimens having desirable levels of yield strength, fracture strength and outer fiber strain. However, the anneal at 1400° C. results in a test specimen having a significantly lower yield strength (about 20% lower); lower fracture strength (about 30% lower) and lower ductility (about 78% lower) than a test specimen annealed at 1350° C. The sharp decline in properties is due to a dramatic change in microstructure due in turn to an extensive beta transformation at temperatures appreciably above 1350° C.

EXAMPLES 4–13

Ten additional individual melts were prepared to contain titanium and aluminum in designated atomic ratios as well as additives in relatively small atomic percents.

Each of the samples was prepared as described above with reference to Examples 1–3.

The compositions, annealing temperatures, and test results of tests made on the compositions are set forth in Table II in comparison to alloy 12 as the base alloy for this comparison.

TABLE II

| Ex. No. | Gamma Alloy No. | Compostn. (at. %) | Anneal Temp. (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| 4 | 22 | $Ti_{50}Al_{47}Ni_3$ | 1200 | —* | 131 | 0 |
| 5 | 24 | $Ti_{52}Al_{46}Ag_2$ | 1200 | —* | 114 | 0 |
| | | | 1300 | 92 | 117 | 0.5 |
| 6 | 25 | $Ti_{50}Al_{48}Cu_2$ | 1250 | —* | 83 | 0 |
| | | | 1300 | 80 | 107 | 0.8 |
| | | | 1350 | 70 | 102 | 0.9 |
| 7 | 32 | $Ti_{54}Al_{45}Hf_1$ | 1250 | 130 | 136 | 0.1 |
| | | | 1300 | 72 | 77 | 0.1 |
| 8 | 41 | $Ti_{52}Al_{44}Pt_4$ | 1250 | 132 | 150 | 0.3 |
| 9 | 45 | $Ti_{51}Al_{47}C_2$ | 1300 | 136 | 149 | 0.1 |
| 10 | 57 | $Ti_{50}Al_{48}Fe_2$ | 1250 | —* | 89 | 0 |
| | | | 1300 | —* | 81 | 0 |
| | | | 1350 | 86 | 111 | 0.5 |
| 11 | 82 | $Ti_{50}Al_{48}Mo_2$ | 1250 | 128 | 140 | 0.2 |
| | | | 1300 | 110 | 136 | 0.5 |
| | | | 1350 | 80 | 95 | 0.1 |
| 12 | 39 | $Ti_{50}Al_{46}Mo_4$ | 1200 | —* | 143 | 0 |
| | | | 1250 | 135 | 154 | 0.3 |
| | | | 1300 | 131 | 149 | 0.2 |
| 13 | 20 | $Ti_{49.5}Al_{49.5}Er_1$ | + | + | + | + |

*See asterisk note to Table I

+ Material fractured during machining to prepare test specimens

For Examples 4 and 5, heat treated at 1200° C., the yield strength was unmeasurable as the ductility was found to be essentially nil. For the specimen of Example 5 which was annealed at 1300° C., the ductility increased, but it was still undesirably low.

For Example 6, the same was true for the test specimen annealed at 1250° C. For the specimens of Example 6 which were annealed at 1300° and 1350° C. the ductility was significant but the yield strength was low.

None of the test specimens of the other Examples were found to have any significant level of ductility.

It is evident from the results listed in Table II that the sets of parameters involved in preparing compositions for testing are quite complex and interrelated. One parameter is the atomic ratio of the titanium relative to that of aluminum. From the data plotted in FIG. 2 it is evident that the stoichiometric ratio or non-stoichiometric ratio has a strong influence on the test properties which formed for different compositions.

Another set of parameters is the additive chosen to be included into the basic TiAl composition. A first parameter of this set concerns whether a particular additive acts as a substituent for titanium or for aluminum. A specific metal may act in either fashion and there is no simple rule by which it can be determined which role an additive will play. The significance of this parameter is evident if we consider addition of some atomic percentage of additive X.

If X acts as a titanium substituent then a composition $Ti_{48}Al_{48}X_4$ will give an effective aluminum concentration of 48 atomic percent and an effective titanium concentration of 52 atomic percent.

If by contrast the X additive acts as an aluminum substituent then the resultant composition will have an effective aluminum concentration of 52 percent and an effective titanium concentration of 48 atomic percent.

Accordingly, the nature of the substitution which takes place is very important but is also highly unpredictable.

Another parameter of this set is the concentration of the additive.

Still another parameter evident from Table II is the annealing temperature. The annealing temperature which produces the best strength properties for one additive can be seen to be different for a different additive. This can be seen by comparing the results set forth in Example 6 with those set forth in Example 7.

In addition there may be a combined concentration and annealing effect for the additive so that optimum property enhancement, if any enhancement is found, can occur at a certain combination of additive concentration and annealing temperature so that higher and lower concentrations and/or annealing temperatures are less effective in providing a desired property improvement.

The content of Table II makes clear that the results obtainable from addition of a ternary element to a non-stoichiometric TiAl composition are highly unpredictable and that most test results are unsuccessful with respect to ductility or strength or to both.

EXAMPLES 14–16

Three additional examples were prepared in the manner described above with reference to Examples 1–3 to certain gallium modified compositions respectively as listed in Table III.

Table III summarizes the blend test results on all of the alloys both standard and modified under the various heat treatment conditions deemed relevant.

TABLE III

Four-Point Bend Properties of Ga—Modified TiAl Alloys

| Ex. | Gamma Alloy Number | Composition (at. %) | Annealing Temperature (°C.) | Yield Strength (ksi) | Fracture Strength (ksi) | Outer Fiber Strain (%) |
|---|---|---|---|---|---|---|
| 2 | 12 | $Ti_{52}Al_{48}$ | 1250 | 130 | 180 | 1.1 |
| | | | 1300 | 98 | 128 | 0.9 |
| | | | 1350 | 88 | 122 | 0.9 |
| | | | 1400 | 70 | 85 | 0.2 |
| 14 | 27 | $Ti_{45}Al_{50}Ga_5$ | 1300 | —* | 20 | 0 |
| | | | 1350 | 72 | 78 | 0.2 |
| 15 | 63 | $Ti_{52}Al_{43}Ga_5$ | 1250 | 122 | 141 | 0.8 |
| | | | 1325 | 104 | 128 | 0.8 |
| | | | 1350 | 101 | 127 | 1.2 |
| | | | 1400 | 83 | 105 | 0.3 |
| 16 | 95 | $Ti_{52}Al_{45}Ga_3$ | 1250 | 123 | 139 | 0.5 |
| | | | 1300 | 115 | 130 | 0.6 |
| | | | 1350 | 93 | 118 | 0.7 |

*No measurable value was found because the sample lacked sufficient ductility to obtain a measurement From the results which are tabulated in Table III above, it is evident that alloy 27 of Example 14 showed inferior strength and outer fiber strain or ductility as compared to the base alloy.

If the alloys 12, 63 and 95 are compared on the basis of the same heat treatment and specifically 1250° C. it is evident that alloy 12 which is the base alloy displays the best combination of properties.

However, where the heat treatment condition which is employed as the basis for comparison is 1350° C., it it evident that alloy 63 becomes the best alloy based on its displaying the combination of the best, that is, the highest strength and ductility. In the connection, it should be noted that the higher treatment, as for example, a 1350° C. heat treatment is the heat treatment which is more likely to be used in actual fabrication of materials inasmuch as the higher heat treatment generally yields larger grain size and the larger grain size affords a better creep resistance. Propeerties which were found to occur for alloy 63 under 1350° C. heat treatment conditions were surprising and unexpected and are deemed to be inventive.

Some further testing of the compositions of the present invention was carried out. In these tests, conventional tensile bars were formed from the alloy specimens of the examples. Tensile testing was done in the conventional fashion and the results obtained are set forth in Table IV immediately below.

TABLE IV

Room Temperature Tensile Properties of Ga—Modified TiAl Alloys

| Ex. | Gamma Alloy Number | Composition (at. %) | Annealing Temperature (°C.) | Yield Strength (ksi) | Fracture Strength (ksi) | Tensile Strain (%) |
|---|---|---|---|---|---|---|
| 2 | 12 | $Ti_{52}Al_{48}$ | 1300 | 77 | 92 | 2.1 |
| 15 | 63 | $Ti_{52}Al_{43}Ga_5$ | 1350 | 73 | 86 | 2.2 |

TABLE IV-continued

| Ex. | Gamma Alloy Number | Room Temperature Tensile Properties of Ga—Modified TiAl Alloys: Composition (at. %) | Annealing Temperature (°C.) | Yield Strength (ksi) | Fracture Strength (ksi) | Tensile Strain (%) |
|---|---|---|---|---|---|---|
| 16 | 95 | $Ti_{52}Al_{45}Ga_3$ | 1325 | 74 | 89 | 2.4 |

From these tests results, it is evident that the alloys of Examples 15 and 16 again display uniquely advantageous tensile properties. It is characteristic of the difference between four-point bend testing and conventional tensile testing that the tensile properties of the bend tests tend to be higher and the ductility properties tend to be lower than those found from the conventional testing. This tendency is borne out by the results as set forth in Tables III and IV.

Figure 3:
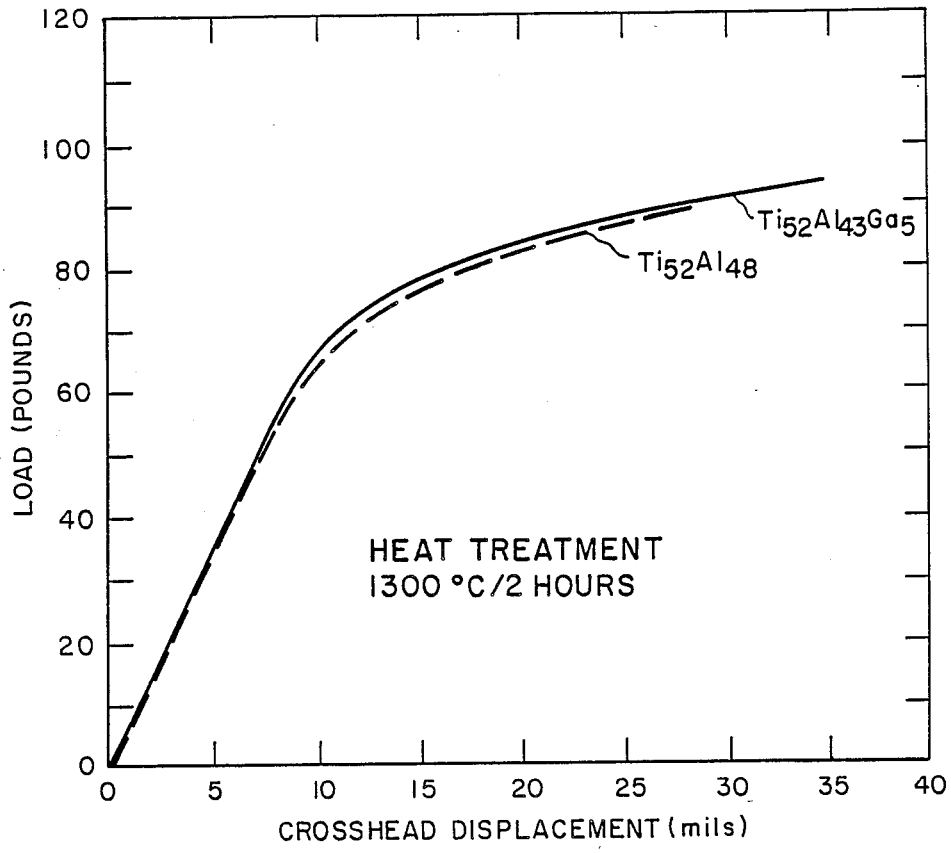
FIG. 3 is a graph illustrating the properties of a gallium modified TiAl in relation to those of FIG. 2.
Figure 4:
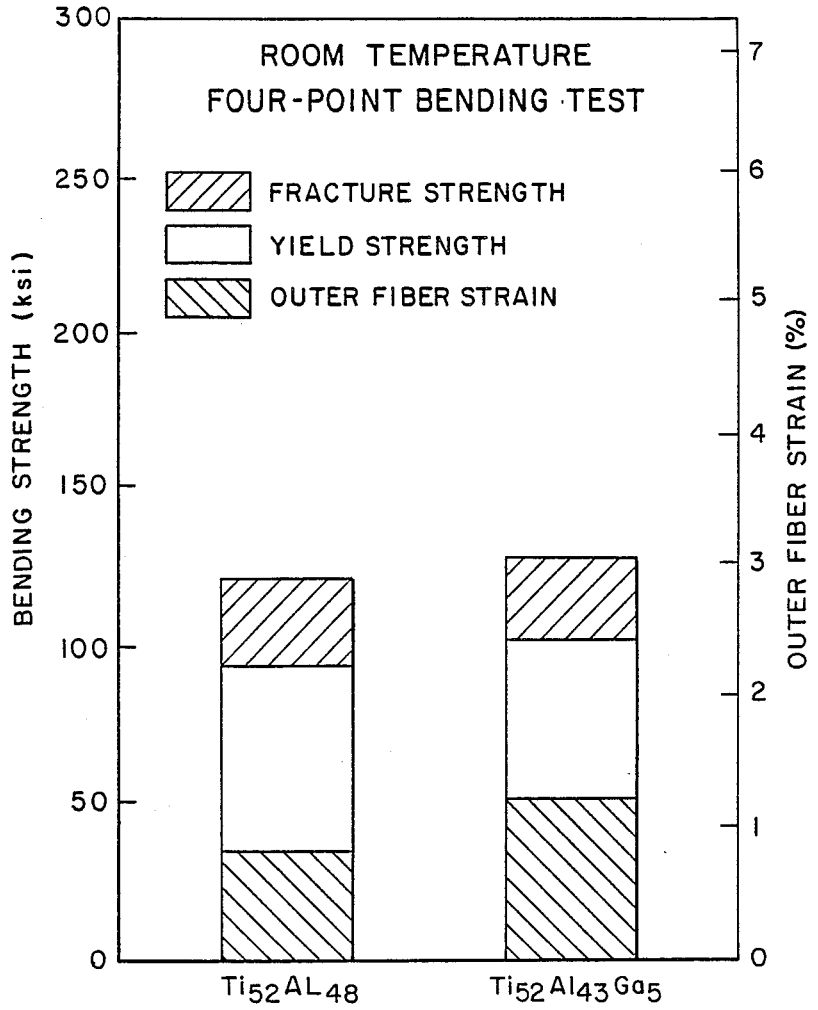
FIG. 4 is a bar graph illustrating the results of a bending test for gallium modified TiAl in relation to $Ti_{52}A_{48}$.

The results of the tests are illustrated graphically in FIGS. 3 and 4. In FIG. 3, the tensile properties of the gallium doped titanium aluminide are illustrated in relation to the values displayed in FIG. 2. In FIG. 4, the fracture strength, yield strength and ductility (or outer fiber strain) of the $Ti_{52}Al_{43}Ga_5$ is illustrated in relation to the similar properties of $Ti_{52}Al_{48}$. The unique advantages of the gallium-doped alloy is evident from the results as plotted in these figures.

What is claimed is:

1. A gallium modified titanium aluminum alloy consisting essentially of titanium, aluminum and gallium in the following approximate atomic ratio:

$$Ti_{52-47}Al_{42-46}Ga_{3-7}.$$

2. A gallium modified titanium aluminum alloy consisting essentially of titanium, aluminum and gallium in the approximate atomic ratio of:

$$Ti_{54-48}Al_{43-45}Ga_{3-7}.$$

3. A gallium modified titanium aluminum alloy consisting essentially of titanium, aluminum and gallium in the following approximate atomic ratio:

$$Ti_{55-49}Al_{42-46}Ga_{3-5}.$$

4. A gallium modified titanium aluminum alloy consisting essentially of titanium, aluminum and gallium in the approximate atomic ratio of:

$$Ti_{54-50}Al_{43-45}Ga_{3-5}.$$

5. The alloy of claim 1, said alloy being rapidly solidified in the melt and consolidated by heat and pressure.

6. The alloy of claim 1, said alloy being rapidly solidified from the melt then consolidated by heat and pressure and given a heat treatment between 1300° C. and 1350° C.

7. The alloy of claim 2, said alloy being rapidly solidified from the melt and consolidated by heat and pressure.

8. The alloy of claim 2, said alloy being rapidly solidified from the melt and then consolidated and given a heat treatment at a temperature between 1300° C. and 1350° C.

9. The alloy of claim 3, said alloy being rapidly solidified from the melt and consolidated by heat and pressure.

10. The alloy of claim 3, said alloy being rapidly solidified from the melt and then consolidated and given a heat treatment at a temperature between 1300° C. and 1350° C.

11. The alloy of claim 4, said alloy being rapidly solidified from the melt and consolidated by heat and pressure.

12. The alloy of claim 4, said alloy being rapidly solidified from the melt and then consolidated and given a heat treatment at a temperature between 1250° C. and 1350° C.

* * * * *